US006732752B2

(12) United States Patent
Cohen et al.

(10) Patent No.: US 6,732,752 B2
(45) Date of Patent: May 11, 2004

(54) FAN ASSEMBLY FOR AN UMBRELLA

(75) Inventors: Ronald B. Cohen, Hopkinton, MA (US); Wayne Wallen, Amston, CT (US)

(73) Assignee: Continental Industries, Inc., Framingham, MA (US)

( * ) Notice: Subject to any disclaimer, the term of this patent is extended or adjusted under 35 U.S.C. 154(b) by 158 days.

(21) Appl. No.: 10/006,097

(22) Filed: Dec. 4, 2001

(65) Prior Publication Data

US 2002/0096203 A1 Jul. 25, 2002

Related U.S. Application Data

(63) Continuation-in-part of application No. 09/550,183, filed on Apr. 14, 2000, now Pat. No. 6,325,084.

(51) Int. Cl.[7] ..... A45B 23/00; F16M 13/00

(52) U.S. Cl. ..... 135/16; 416/244 R; 417/313

(58) Field of Search ..... 416/244 R, 146 R, 416/204 R; 135/16; 417/313

(56) References Cited

U.S. PATENT DOCUMENTS

| | | | | |
|---|---|---|---|---|
| 1,148,332 A | | 7/1915 | Onyskow | |
| 3,177,881 A | | 4/1965 | Covington | |
| 5,007,811 A | | 4/1991 | Hopkins | |
| 5,172,711 A | | 12/1992 | Mueller et al. | |
| 5,273,062 A | | 12/1993 | Mozdzanowski | |
| 5,349,975 A | | 9/1994 | Valdner | |
| 5,765,582 A | | 6/1998 | Molnar, IV | |
| 5,887,771 A | | 3/1999 | Perry | |
| D409,369 S | | 5/1999 | Vega | |
| 5,967,161 A | | 10/1999 | Neal | |
| RE36,514 E | * | 1/2000 | Clark | 416/110 |
| 6,017,188 A | | 1/2000 | Benton | |
| 6,027,309 A | | 2/2000 | Rawls et al. | |
| 6,230,723 B1 | * | 5/2001 | Hixson | 135/16 |
| 6,325,084 B1 | * | 12/2001 | Cohen | 135/16 |
| 2003/0102021 A1 | * | 6/2003 | Cohen et al. | 135/16 |

FOREIGN PATENT DOCUMENTS

| | | | | |
|---|---|---|---|---|
| RO | 108408 B1 | * | 5/1994 | A45B/11/04 |

* cited by examiner

*Primary Examiner*—Robert Canfield
(74) *Attorney, Agent, or Firm*—Iandiorio & Teska

(57) ABSTRACT

A fan assembly for an umbrella including a first integrated sub-assembly clampable about an umbrella pole. The first integrated sub-assembly has a split collar surrounding the umbrella pole, a support housing on a lower end of the collar defining a drive ring support plate, and a motor housing enclosing a motor therein on an upper end of the collar spaced from the drive ring support plate. A second integrated sub-assembly is rotatably disposable about the collar and the umbrella pole and includes a drive ring having a lower surface which is supported by the drive ring support plate of the support housing, a drive ring drive mechanism, and a plurality of fan blades coupled to the drive ring.

44 Claims, 9 Drawing Sheets

FAN ASSEMBLY FOR AN UMBRELLA

PRIORITY CLAIM

This application is a continuation in part of application Ser. No. 09/550,183 filed Apr. 14, 2000 now U.S. Pat. No. 6,325,084 entitled "Combined Umbrella and Fan Device" (now allowed).

FIELD OF THE INVENTION

This invention relates to a fan assembly for an umbrella and also to a fan assembly which can be coupled to a pole even without an umbrella.

BACKGROUND OF THE INVENTION

There has long been a need for a self-contained, easy to assemble, low cost, universal, and safe umbrella fan. The design constraints associated with such an umbrella fan include the fact that the umbrella canopy is often lowered when not in use by the action of a slide which surrounds the umbrella pole operated by a crank mechanism which also surround the umbrella pole. Thus, any useful after-market umbrella fan assembly must be able to be easily coupled by the consumer to the umbrella pole between the crank mechanism and the umbrella canopy slide.

U.S. Pat. No. 6,017,188 discloses a fan assembly permanently disposed on the umbrella pole above the slide. Accordingly, this assembly is not designed as an after-market fan which can be used in conjunction with a wide variety of umbrellas previously purchased by consumers.

U.S. Pat. No. 5,007,811 discloses a fan assembly supported on an umbrella pole below the umbrella slide but requires, in each embodiment, bearings supporting the integral rotatable drive ring to which the fan blades are attached. In one embodiment, the large drive gear of the rotatable drive ring and the drive ring itself have a slot therethrough for receiving the umbrella shaft. To compensate for this slot, either two opposing drive pinions are required (one on either side of the slot) or, instead, a special gear key is required to fill the gap in the drive gear, and, in that embodiment, only one drive pinion is required.

The '811 patent also purports to show an embodiment where the drive gear and the drive ring are split and pivot about a hinge. Still, even in this embodiment, the bearings supporting the rotatable drive ring are still required as part of the fan assembly housing. Since, in the design of the '811 patent the drive ring is an integral part of the fan motor housing, the resulting structure is necessarily complex and difficult to manufacture at a low cost. Finally, the '188 patent notes that the fan assembly of the '811 patent is unstable.

SUMMARY OF THE INVENTION

It is therefore an object of this invention to provide a self-contained after-market fan assembly for umbrellas.

It is a further object of this invention to provide such a fan assembly which is easy to assemble.

It is a further object of this invention to provide such a fan assembly which can be manufactured and sold at a low cost.

It is a further object of this invention to provide such a fan assembly which is universal in design and can accommodate different umbrella pole diameters and a variety of umbrella configurations.

It is a further object of this invention to provide such a fan assembly which is safe and harmless even if a child's hand purposefully or inadvertently comes into contact with one of the fan blades.

It is a further object of this invention to provide such a fan assembly which can be easily slid down the umbrella pole when the umbrella canopy is folded down and not in use and then slid back up the umbrella pole and into position when the umbrella canopy is deployed.

It is a further object of this invention to provide such a fan assembly which has easily removable fan blades.

It is a further object of this invention to provide such a fan assembly which is battery operated.

It is a further object of this invention to provide such a fan assembly which comes complete with rechargeable batteries and a recharger for recharging the rechargeable batteries.

It is a further object of this invention to provide such a fan assembly which does not require multiple drive pinions or a special gear key.

It is a further object of this invention to provide such a fan assembly in which the drive ring is not an integral part of the fan motor housing and thus requires no rotatable bearings.

The invention results from the realization that a self contained, universal, low cost, and safe umbrella fan assembly which is easy to assemble and which also can be quickly moved down the umbrella pole when the umbrella canopy is folded down is effected by two separate assemblies: a split collar clampable around the umbrella pole and having integrated support and motor housings, and, a separate fan blade drive ring with an integral drive gear. This design is in contrast with the assembly of U.S. Pat. No. 5,007,811 in which the drive ring is an integral part of the motor housing and thus requires expensive bearings and a complex drive train to accommodate the slot in the motor housing.

This invention features an umbrella pole fan comprising a first integrated sub-assembly clampable about the pole. The first integrated sub-assembly including a collar surrounding the pole, a support housing on a lower end of the collar defining a drive ring support plate, and a motor housing enclosing a motor therein on an upper end of the collar spaced from the drive ring support plate. Also featured is a second integrated sub-assembly rotatably disposable about the umbrella pole. The second integrated sub-assembly includes a drive ring rotatably disposed about the collar and having a lower surface which is supported by the drive ring support plate of the support housing. The second integrated sub-assembly also features a drive ring drive mechanism, and a plurality of fan blades coupled to the drive ring.

In the preferred embodiment, the drive ring support plate includes a plurality of spaced non-rotatable bearing members extending upwards therefrom on which the lower surface of the drive ring rotates. The motor housing typically includes a motor drive mechanism depending downward therefrom which cooperates with the drive ring drive mechanism to rotate the drive ring. In one embodiment, the motor drive mechanism is a first gear and the drive ring drive mechanism is a second gear which is engaged by the first gear. The drive train sub-assembly of this embodiment typically includes a motor pulley, an intermediate pulley, a pulley attached to the first gear, a first belt about the motor pulley and the intermediate pulley, and a second belt about the intermediate pulley and the pulley of the first gear.

Preferably, the motor housing includes a DC motor, one or more rechargeable DC batteries for powering the DC motor, and a recharging device for the DC batteries. Typically, the support housing includes a switch electrically coupled to the motor in the motor housing. Also, the upper end of the collar preferably includes a clamp mechanism such as a quick release clamp which secures the first integrated sub-assembly on the pole. In this way, the position of the fan assembly on an umbrella pole is easily and quickly adjusted when the umbrella canopy is lowered for storage and raised for use. In one example, the second integrated sub-assembly includes a spacer element disposed between the drive ring drive mechanism and the upper surface of the drive ring.

Preferably, the drive ring includes a plurality of fan blade blocks located thereon each having a channel for receiving a fan blade therein. The fan blades then have a distal end with at least one spring mechanism for retaining the distal end of the fan blades in the channels of the blade blocks.

In the preferred embodiment, the first integrated sub-assembly is configured as in a plurality of sections coupled together about the pole and the second integrated sub-assembly is also configured in a plurality of sections coupled together about the first integrated sub-assembly.

The support housing may further include at least one lamp. Preferably, the drive train sub-assembly coupling the motor to the drive ring drive mechanism is configured to slip if there is interference with a fan blade to stop the drive ring from rotating. As such, the drive train sub-assembly includes at least one belt which slips if there is interference with a fan blade.

This invention also features a fan blade assembly for a pole, the fan blade assembly comprising a support housing coupled to but spaced from a motor housing having a motor therein. Each housing is configured in sections which can be clamped about a pole. A separate drive ring with fan blades extending therefrom is also configured in sections which can be disposed about the pole. The drive ring is disposed between the motor housing and the support housing and supported for rotation on the support housing. Typically, a split collar is provided and the support housing is attached to a lower end of the split collar and the motor housing is attached to an upper end of the split collar. The separate drive ring is rotatably disposed about the split collar between the support housing and the motor housing. In one example, the support housing includes an upper drive ring support plate and there is a drive ring drive mechanism integrated with the drive ring. The drive ring support plate may include a plurality of spaced non-rotatable bearing members extending upwards therefrom on which a lower surface of the drive ring rotates.

The motor housing preferably includes a motor drive mechanism depending downward therefrom which cooperates with a drive ring drive mechanism integral with the drive ring to rotate the drive ring.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
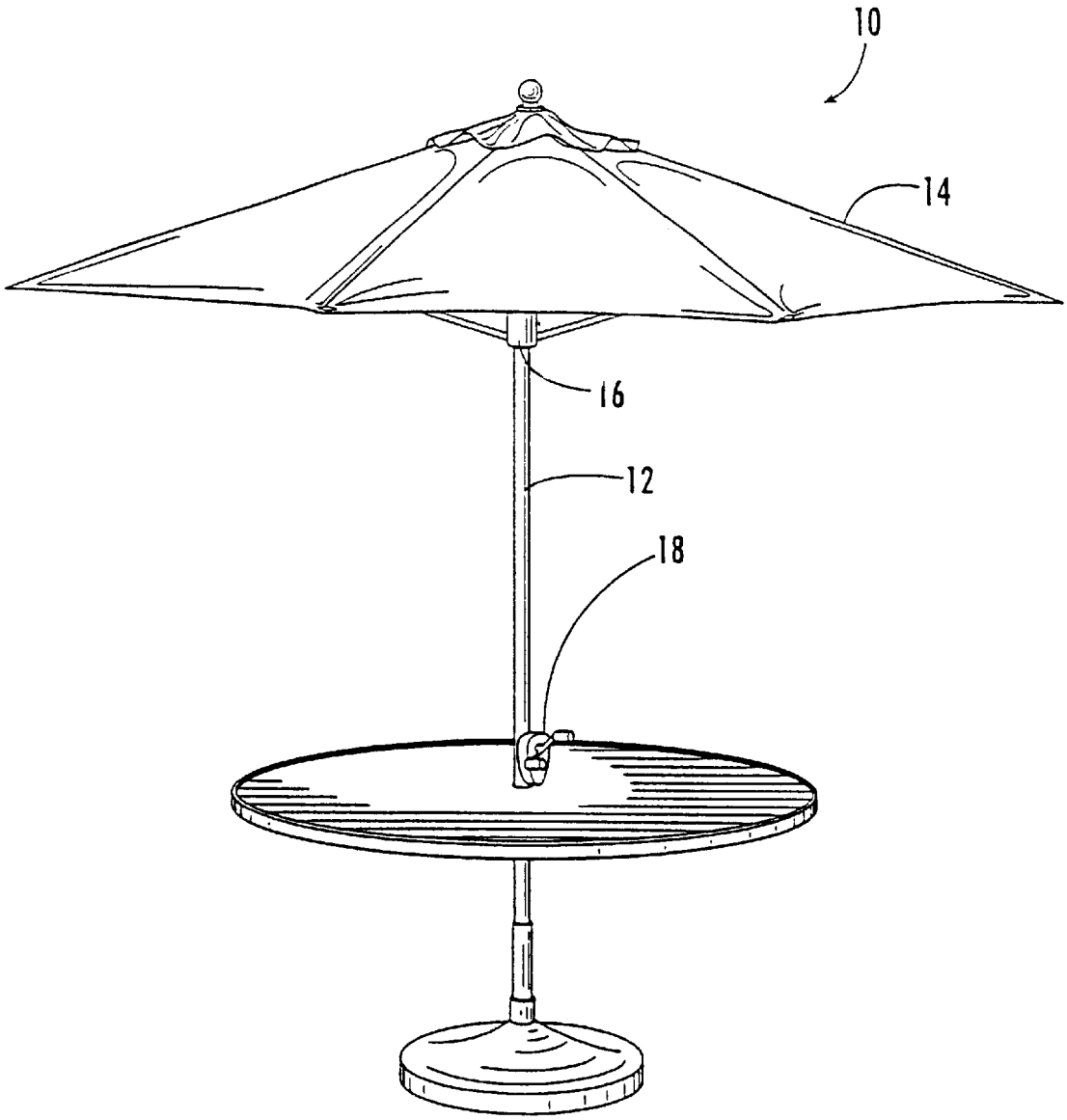
FIG. 1. (PRIOR ART)
FIG. 1 is a schematic view of a typical umbrella assembly.

Conventional umbrella 10, FIG. 1 includes pole 12 and canopy 14 which is lowered and raised as slide 16 moves up and down on pole 12 by the operation of crank mechanism 18.

Thus, many consumers have umbrellas which cannot accommodate a fan assembly unless it can be easily coupled about pole 12 between crank mechanism 18 and slide 16. In addition, when umbrella 10 is not in use and canopy 14 is folded downward, the fan assembly must be moveable down the pole so it does not interfere with the operation of slide 16. In addition, any after-market fan assembly design must take into account the fact that the umbrella is often lowered when not in use. Thus, the fan assembly must be easily coupled by the consumer to the pole between the crank mechanism and the slide but also quickly movable down the pole. In addition, any marketable fan assembly must be self-contained, low cost, universal in design, safe, and preferably battery operated to avoid the need for extension cords and the like. Any fan assembly which does not meet these design constraints will not be accepted by consumers.

Figure 2:
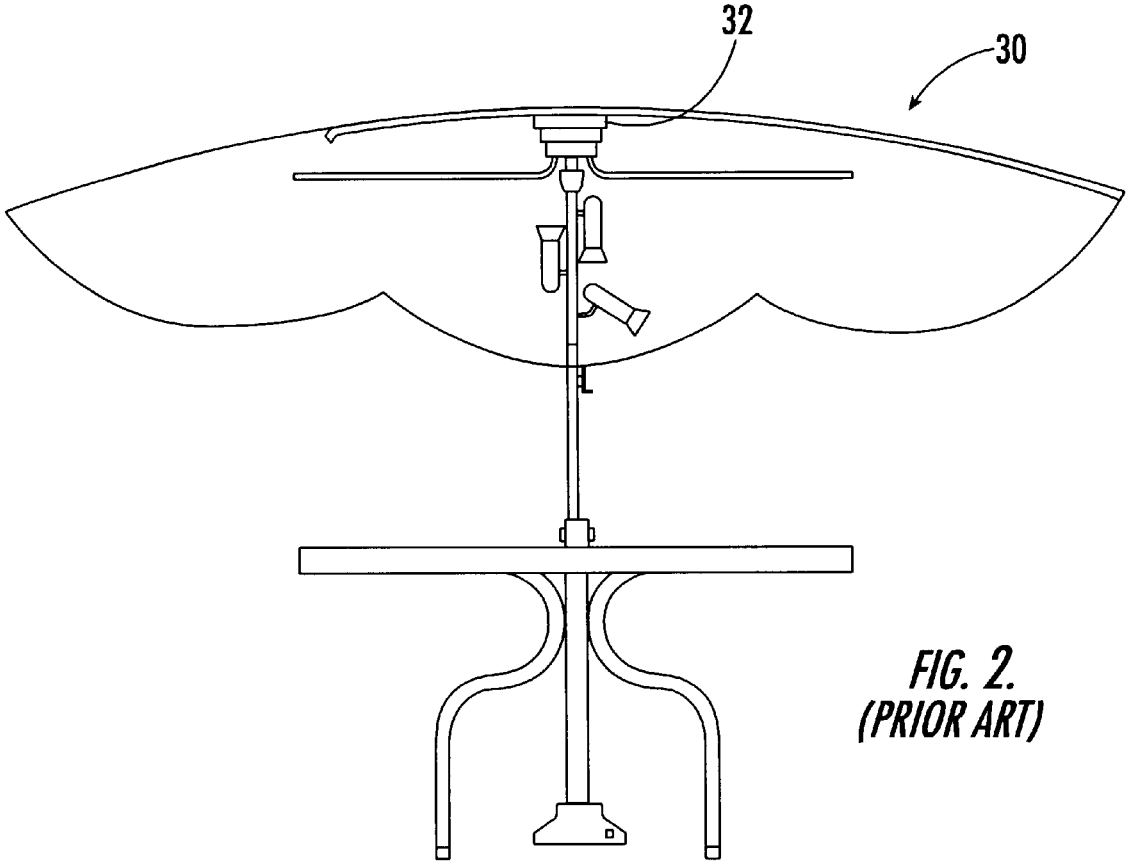
FIG. 2. (PRIOR ART)
FIG. 2 is a schematic view of a prior art patio table and pole fan combination in accordance with the prior art.

Umbrella 30, FIG. 2 with integral fan assembly 32 is disclosed in U.S. Pat. No. 6,017,188 incorporated herein by this reference. Unfortunately, fan assembly 32 must be incorporated as a component of umbrella 30 and thus, a consumer with umbrella 10, FIG. 1 cannot incorporate fan assembly 32, FIG. 2 therewith.

Figure 3:
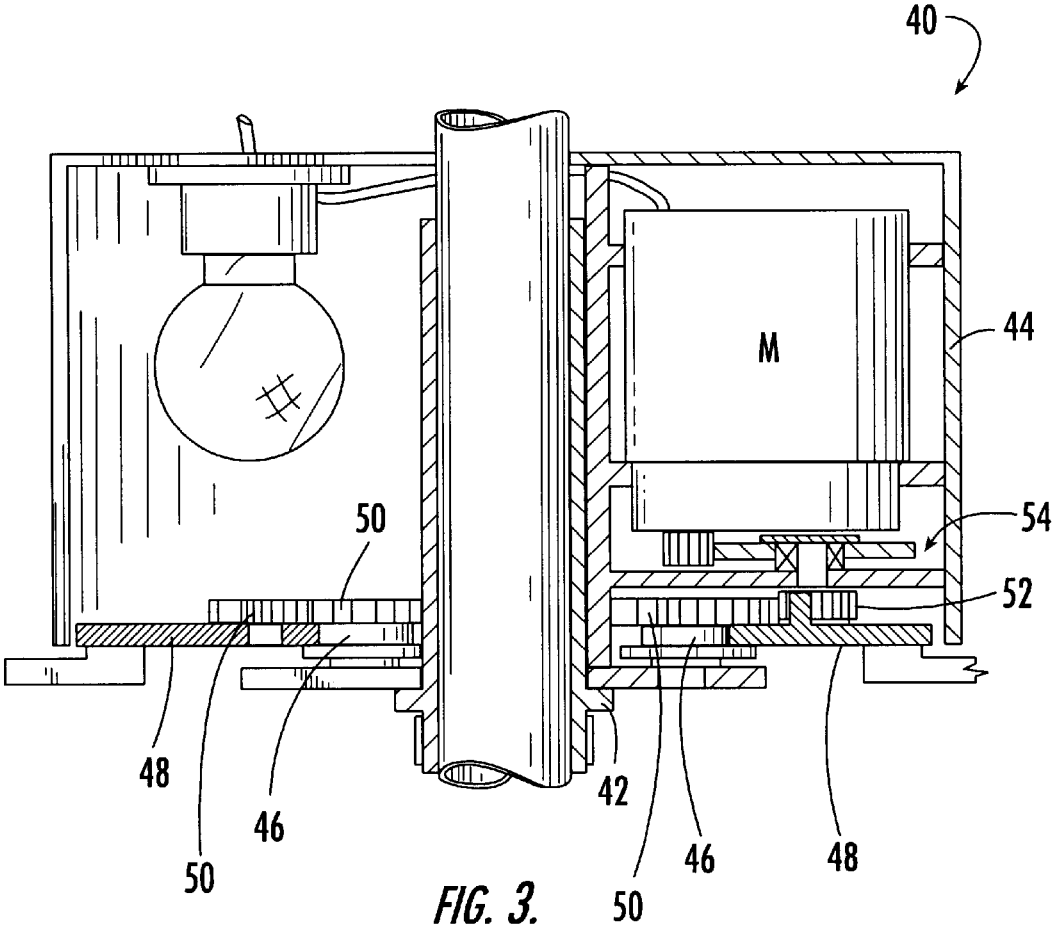
FIG. 3. (PRIOR ART)
FIG. 3 is a schematic cut away view of another prior art fan assembly.

U.S. Pat. No. 5,007,811, also incorporated herein by this reference, discloses after-market fan assembly 40, FIG. 3. Unfortunately, assembly 40 is complex in design and expensive to manufacture. Support 42 supports motor housing 44 thereon. Motor housing 44 then requires bearings 46 which, in turn, support integral fan blade drive ring 48 thereon. Drive gear 50 of drive ring 48 is driven by gear 52 which is coupled to motor M via gear train 54. The large drive gear of the rotatable drive ring (and the drive ring itself) have, in all the preferred embodiments, a slot therethrough for receiving the umbrella shaft. To compensate for this slot, either two opposing drive pinions are required (one on either side of the slot) or, instead, a special gear key is required to fill the gap in the drive gear. As delineated in the background section above, the '811 patent also purports to show an embodiment where the drive gear and the drive ring are split and pivot about a hinge. Still, even in this embodiment, bearings are required to support the rotatable drive ring and the drive ring itself forms an integral part of the fan assembly housing. Since, in the design of the '811 patent, the drive ring is an integral part of the fan motor housing, the resulting structure is necessarily complex, difficult to manufacture, and results in a costly fan assembly.

In the subject invention, in contrast, the drive ring is decoupled from the motor housing and provided to the consumer as a separate component thus providing a better, self-contained, easy to assemble, lower cost, universal in design, and safe fan assembly. Also, the support for the drive ring, a portion of the integral housing assembly which also includes the motor housing, does not require any rotating bearings, drive pinions, or keys.

Figure 4:
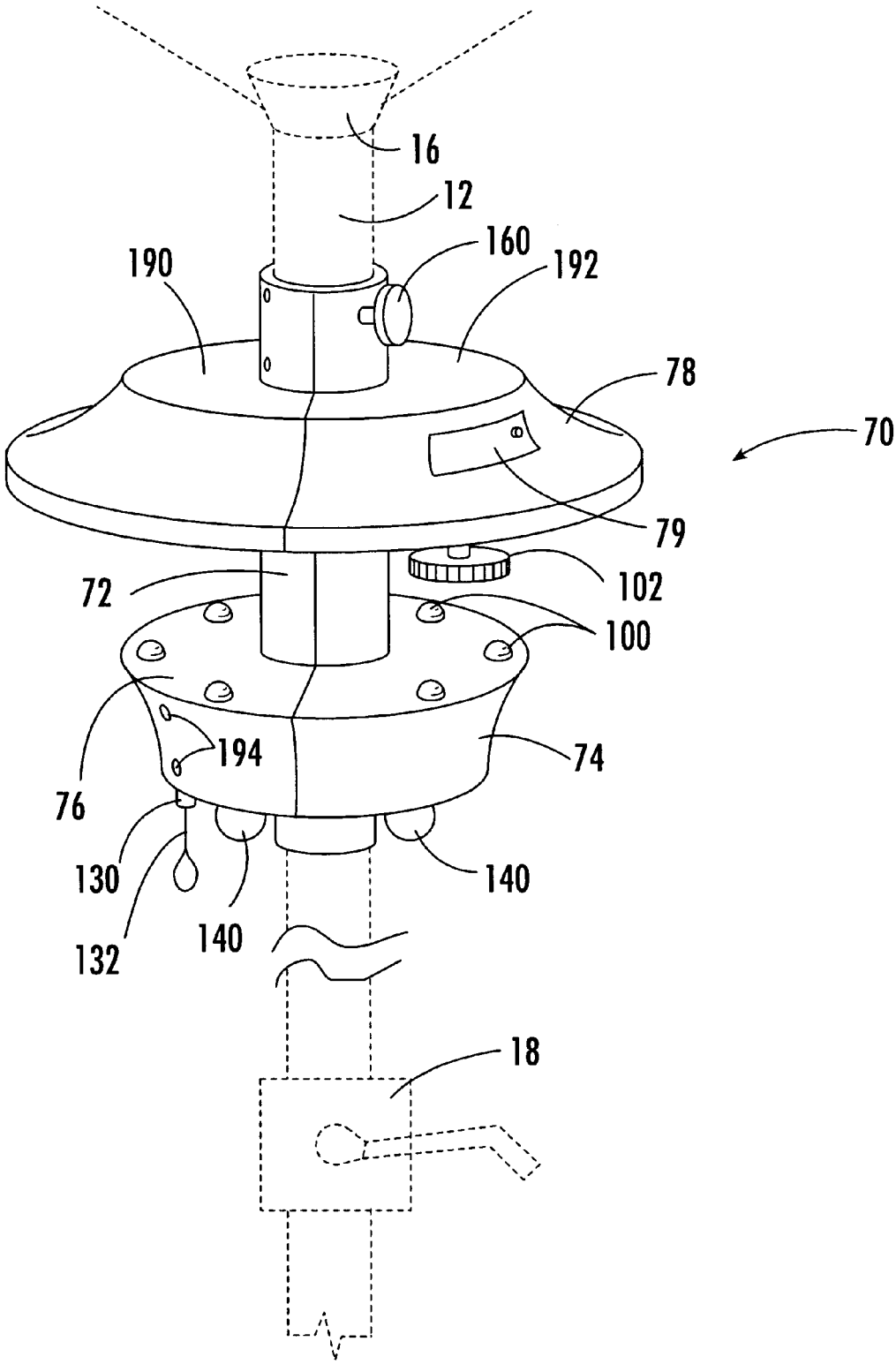
FIG. 4 is a schematic three-dimensional view showing the first integral sub-assembly of the subject invention clampable about an umbrella pole in accordance with the subject invention.

As shown in FIG. 4, the fan assembly of this invention, in one embodiment, includes first integral sub-assembly 70 clampable about umbrella pole 12 (see FIG. 1) in a variety of positions between slide 16 and crank mechanism 18 and also moveable up and down between slide 16 and crank mechanism 18. In this way, when the canopy of the umbrella is brought downward, the complete fan assembly of the subject invention can also be brought down and out of the way to ensure that it does not interfere with the operation of closing the umbrella canopy.

Integral sub-assembly 70, FIG. 4 includes lengthy split collar 72 surrounding umbrella pole 12. Affixed to collar 72 at the lower end thereof is support housing 74 defining drive ring support plate 76. Spaced from support housing 74 is motor housing 78 enclosing a motor (not shown in FIG. 4) and disposed on an upper end of collar 72. Access door 79 allows access to the rechargeable 12 to 24 volt battery which powers the motor inside motor housing 78. In alternative embodiments, for packaging reasons, motor housing 78 and/or support housing 74 may be provided to the consumer detached from collar 72. The consumer then couples motor housing 78 and/or support housing 74 to collar 72. Still, even in these embodiments, sub-assembly 70 is integral when assembled about the umbrella pole. Thus, integral, as used herein, does not necessarily mean unitary or one-piece.

Figure 5:
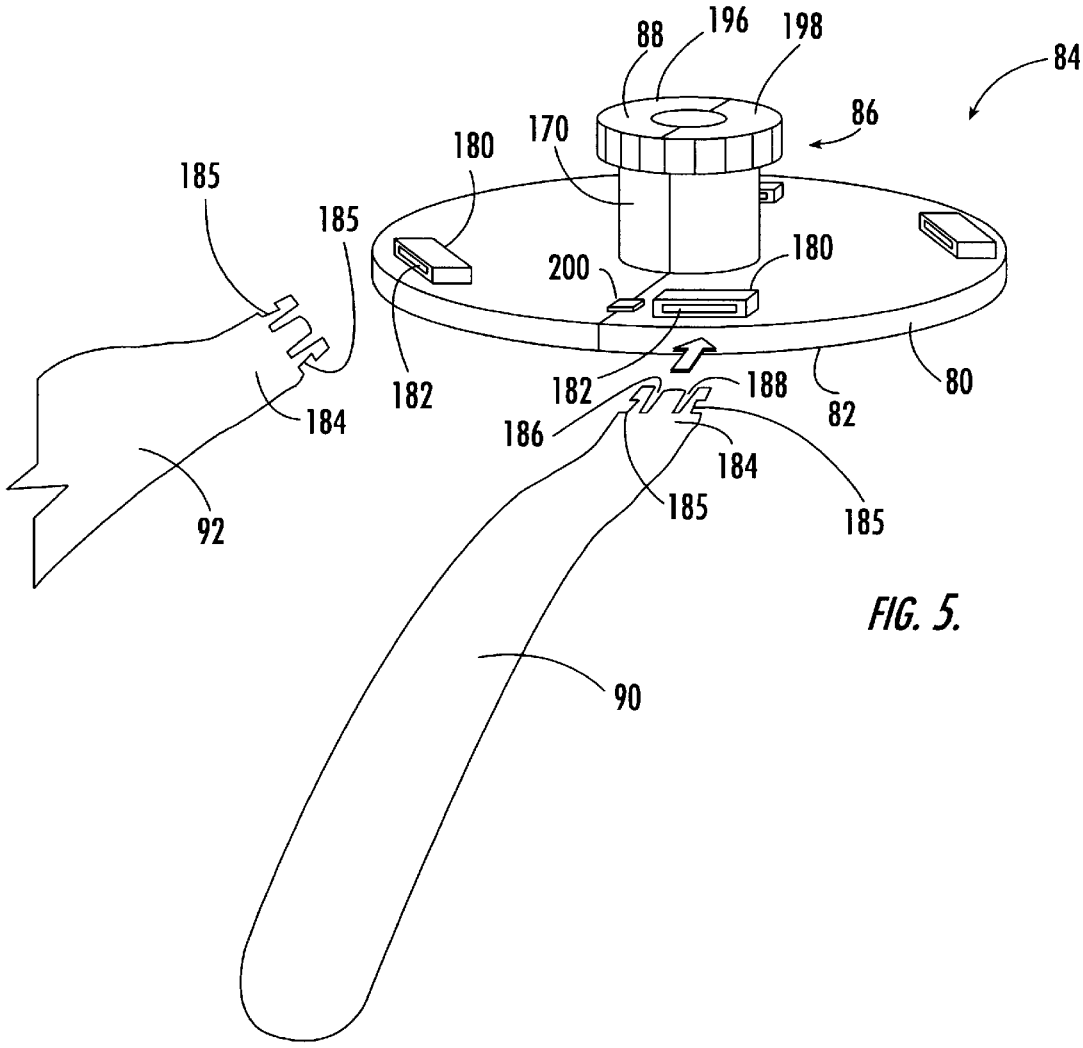
FIG. 5 is a schematic three dimensional view showing the second integral sub-assembly of the fan assembly of the subject invention.

The second integral sub-assembly 84, FIG. 5, of this invention, includes drive ring 80 having a lower surface 82 which is supported by drive ring support plate 76, FIG. 4 of support housing 74. Assembly 84 also includes drive mechanism 86, for example drive gear 88, and fan blades 90, 92 etc. coupled to drive ring 80. Integral sub-assembly 84 is disposed between motor housing 78, FIG. 4 and support housing 74 and freely rotates about split collar 72.

In one example, drive ring support plate 76, FIG. 4 includes a plurality of spaced non-rotatable bearing members 100 made of or including a Teflon finish, for example, upstanding from plate 76. Lower surface 82, FIG. 5 of drive ring 80 is rotatably disposed on bearing members 100. In this way, the complex and expensive bearings 46, FIG. 3 of the prior art are eliminated.

Motor housing 78, FIG. 4 typically includes motor drive gear 102 which engages drive ring gear 88, FIG. 5 although pulleys and belt drives may also be used.

Figure 6:
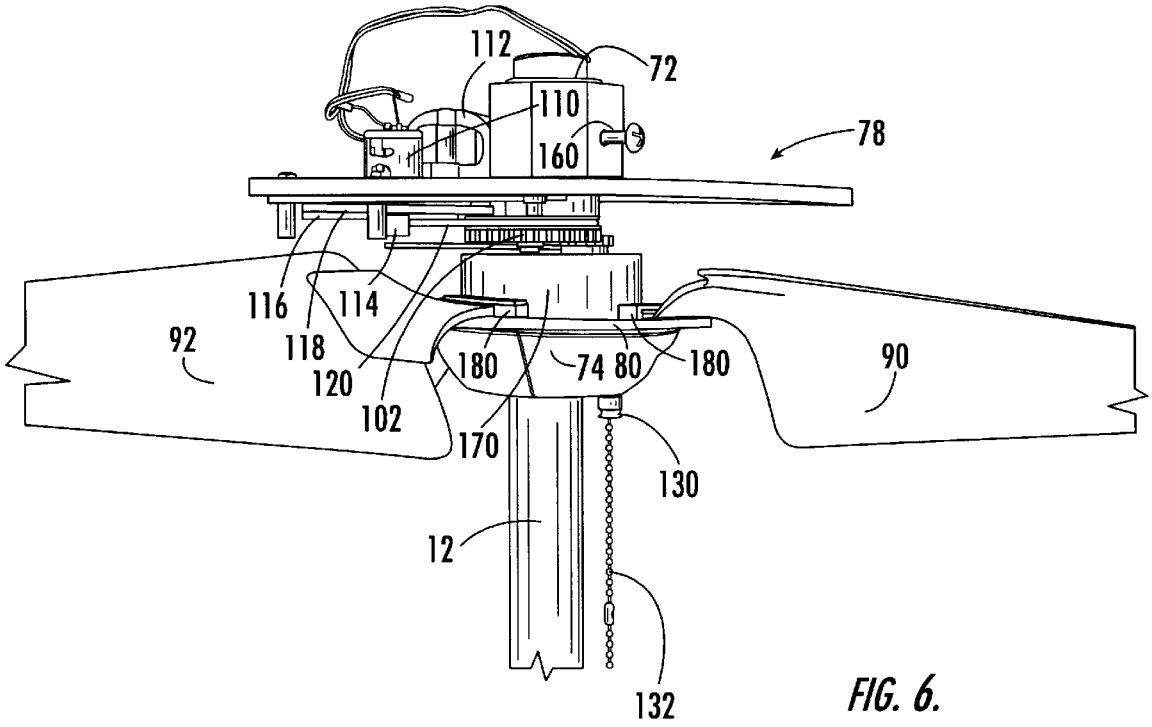
FIG. 6 is a schematic three dimensional view showing the orientation of the sub-assemblies of FIGS. 4 and 5 in place on an umbrella pole.
Figure 7:
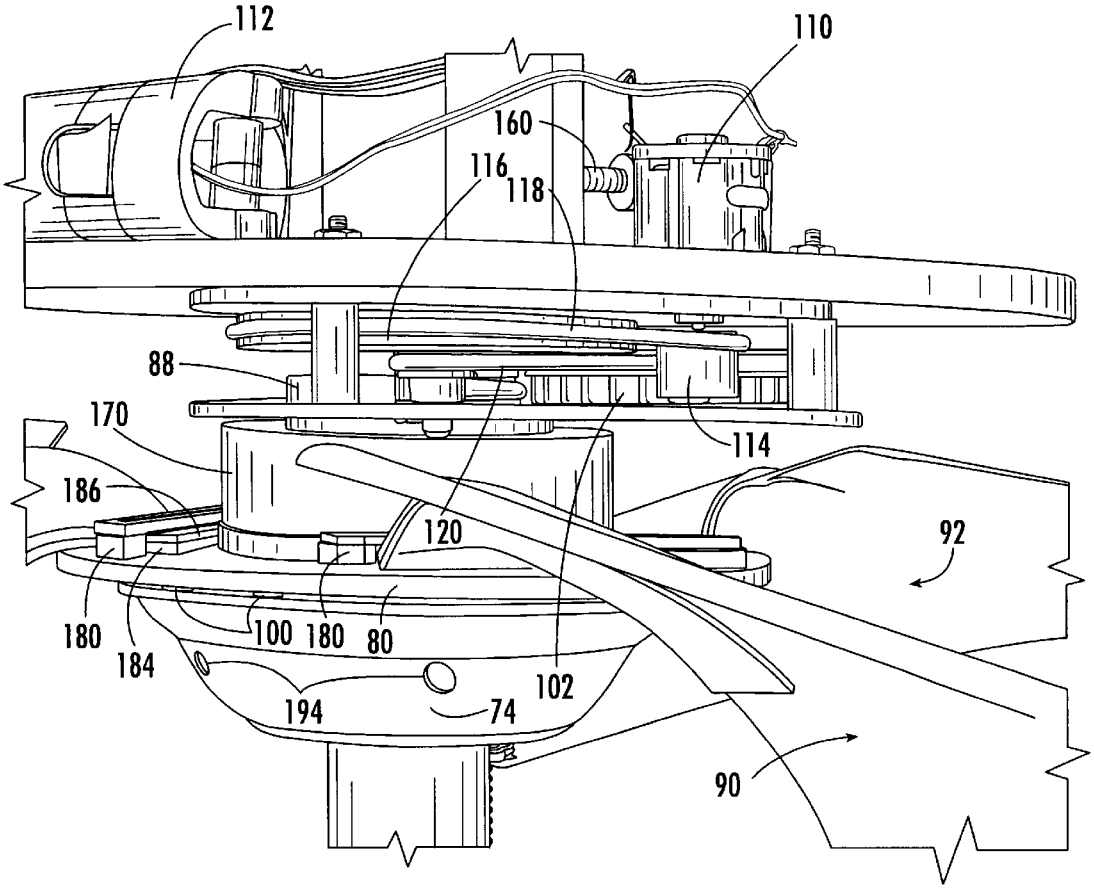
FIG. 7 a view similar to FIG. 6 showing the primary components associated with the fan assembly of the subject invention.
Figure 8:
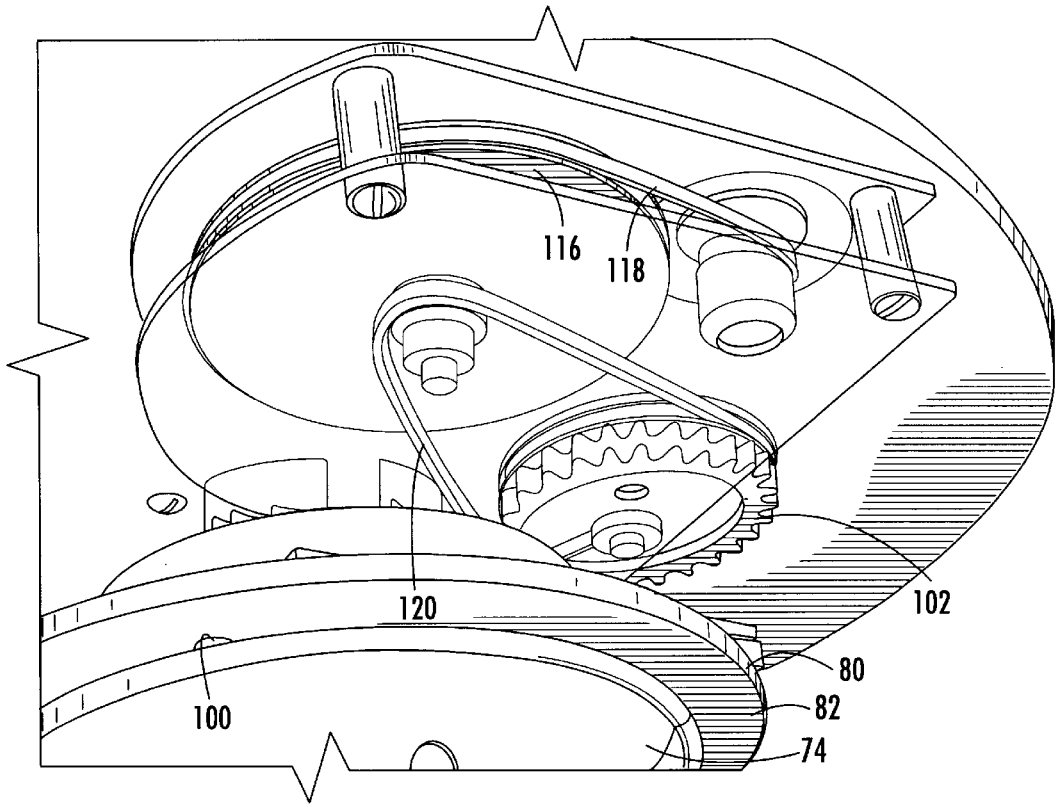
FIG. 8 is another schematic three dimensional view showing an enlarged view of the motor drive train assembly of one embodiment of this invention.

FIGS. 6–8 depict, in the prototype device, the combination of first sub-assembly 70, FIG. 4 and second sub-assembly 84, FIG. 5 disposed about umbrella pole 12 with the cover of motor housing 78 removed. Motor 110, powered by rechargeable DC battery 112, includes motor pulley 114 which drives intermediate pulley 116 via belt 118. Belt 120 is disposed between intermediate pulley 116 and motor drive gear 102. By the use of belts 118 and 120, if a fan blade is interfered with (consider a child's hand), the belts will slip on their respective pulleys thus providing a safe fan assembly in accordance with this invention. To that end, fan blades 90, 92, etc. are preferably made of plastic to further realize a safe after-market fan assembly in accordance with the subject invention.

Although the drive train depicted in FIGS. 6–8 includes motor pulley 114, intermediate pulley 116, motor drive gear 102, and belts 118 and 120, other drive train assemblies are possible in accordance with the subject invention including slip clutches or other mechanisms which prevent harm to the consumer if a body part contacts a fan blade.

Switch 130 including chain pull 132, FIGS. 4 and 6, turns motor 110, FIG. 6 and optional lamps 140, FIG. 4 on and off in the same manner as the conventional household electrical fan. Thus, switch 130 is electrically coupled to motor 110 and lamps 140 via wires, for example.

Clamp mechanism 160, FIGS. 4, 6, and 7 secures assembly 70 to umbrella pole 12 and may either include, as shown, a bolt which extends through split collar 72 to bear upon the umbrella pole or, alternatively, a quick release type clamp for quickly adjusting the position of the fan assembly on the umbrella pole especially when the umbrella is lowered for storage and then later raised for use. Various quick release type clamps are known in the mechanical arts and are used in conjunction with, for example, bicycle seats.

Spacer element 170, FIGS. 5–7, is disposed between drive gear 88 and the upper surface of drive ring 80. To enable quick coupling and decoupling of fan blades 90, 92, FIGS. 5–7 to drive ring 80, three to four fan blade blocks 180 are preferably located on the upper surface of drive ring 80. Each block 180 has a channel 182 therethrough for receiving the proximal end of a fan blade therein. The distal end of each of the three to four fan blades has a tang 184 including channels 185 and cut-outs 186, 188, FIG. 5 forming a spring mechanism for retaining the distal end of the fan blade in the channels of the fan blade blocks (see FIG. 7). Fewer or more fan blades may also be provided.

In the preferred example above, first integral sub-assembly 70, FIG. 4 which includes, inter alia, collar 72, support housing 74, and motor housing 78, is configured in two sections 190, 192 secured together about pole 12 by fasteners 194 (see also FIG. 7). Second integral structure 84, FIG. 5 is also preferably configured in two sections 196, 198 coupled together about collar 72 and the umbrella pole by similar fasteners or clamps such as clamp 200.

Figure 9:
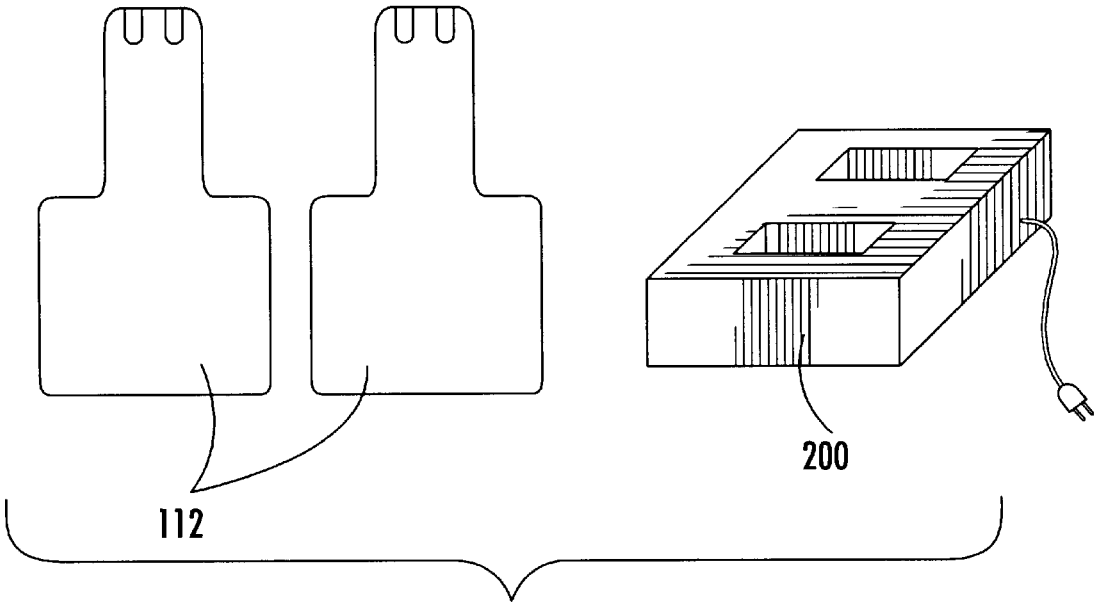
FIG. 9 is a schematic view showing the rechargeable batteries and the battery charger kit sub-components of the fan assembly of this subject invention.

FIG. 9 shows recharger 200 and two batteries 112 which may be supplied to the consumer along with the first 70 and second 84 integrated sub-assemblies of FIGS. 4 and 5, respectively. Most of the components of the fan assembly of this invention may be made of plastic and, in the preferred embodiment, each section 190, 192 of integral sub-assembly 70, FIG. 4 is made from a mold as are each section 196, 198 of integral sub-assembly 84, FIG. 5 and fan blades 90, 92. The motor and the drive train sub-assembly shown in FIGS. 6–8 is then assembled in motor housing 78, FIG. 4. The result is a lower cost fan assembly which is easily manufactured. Alternatively, each sub-assembly may be manufactured in numerous pieces and then provided to the consumer as discussed above.

The fan assembly of this invention is thus easy to assemble and can be manufactured and sold at a low cost. Moreover, the fan assembly is universal in design and can accommodate different umbrella pole diameters and different types of umbrella configurations. The fan assembly of this invention is relatively safe and harmless even if a child's hand purposefully or inadvertently comes into contact with one of the fan blades. By loosening clamp mechanism 160, FIG. 4, the complete fan assembly can be easily slid down the umbrella pole when the umbrella canopy is folded down and not in use and then slid back up the umbrella pole and into the proper position when the umbrella canopy is deployed. Fan blades 92, 90, FIG. 5 are easily removed for storage. The fan assembly is preferably battery operated and typically includes rechargeable batteries and a recharger for recharging the rechargeable batteries. Typically, multiple drive pinions or a special gear key are not required. In the preferred embodiment, drive ring 80, FIG. 5 is not an integral part of fan motor housing 78, FIG. 4 and thus no expensive rotatable bearings are required.

The self contained, universal, low cost, and safe umbrella fan assembly of this invention is easy to assemble and also can be quickly moved down the umbrella pole when the umbrella canopy is folded down by the design of two separate sub-assemblies: a) split collar 72, FIG. 4 clampable around the umbrella pole and having integral support 74 and motor 78 housings, b) and fan blade drive ring 80, FIG. 5 with integral drive gear 86. This design is in contrast with the assembly of U.S. Pat. No. 5,007,811 in which the drive ring is an integral part of the motor housing and thus requires expensive bearings and a complex drive train to accommodate the slot in the motor housing.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. For example, the sub-assemblies disclosed herein may be hingable about the umbrella pole and/or include a slot which receives the umbrella pole therein.

Other embodiments will occur to those skilled in the art and are within the following claims:

What is claimed is:

1. A fan assembly comprising:

a first integrated sub-assembly clampable about a pole, the first integrated sub-assembly including:

a collar surrounding the pole;

a support housing on a lower end of the collar defining a drive ring support plate;

a motor housing enclosing a motor therein on an upper end of the collar spaced from the drive ring support plate; and a second integrated sub-assembly rotatably disposable about the pole, the second integrated sub-assembly including:

a drive ring rotatably disposed about the collar and having a lower surface which is supported by the drive ring support plate of the support housing, a drive ring drive mechanism, and a plurality of fan blades coupled to the drive ring.

2. The fan assembly of claim 1 in which the drive ring support plate includes a plurality of spaced non-rotatable bearing members extending upwards therefrom on which the lower surface of the drive ring rotates.

3. The fan assembly of claim 1 in which the motor housing includes a motor drive mechanism depending downward therefrom which cooperates with the drive ring drive mechanism to rotate the drive ring.

4. The fan assembly of claim 3 in which the motor drive mechanism is a first gear and the drive ring drive mechanism is a second gear which is engaged by the first gear.

5. The fan assembly of claim 4 in which the motor housing includes a motor, a motor pulley, an intermediate pulley, a pulley attached to the first gear, a first belt about the motor pulley and the intermediate pulley, and a second belt about the intermediate pulley and the pulley of the first gear.

6. The fan assembly of claim 1 in which the motor housing includes a DC motor and a rechargeable DC battery for powering the DC motor.

7. The fan assembly of claim 6 further including a recharging device for the DC battery.

8. The fan assembly of claim 1 in which the support housing includes a switch electrically coupled to the motor in the motor housing.

9. The fan assembly of claim 1 in which the upper end of the collar includes a clamp mechanism which secures the first integrated sub-assembly on the pole.

10. The fan assembly of claim 9 in which the clamp mechanism is quick release type clamp for quickly adjusting the position of the fan assembly on an umbrella pole when an umbrella canopy is lowered for storage and raised for use.

11. The fan assembly of claim 1 in which the second integrated sub-assembly includes a spacer element disposed between the drive ring drive mechanism and the upper surface of the drive ring.

12. The fan assembly of claim 1 in which the drive ring includes a plurality of fan blade blocks located thereon each having a channel for receiving a fan blade therein.

13. The fan assembly of claim 12 in which the fan blades have a distal end with at least one spring mechanism for retaining the distal end of the fan blades in the channels of the fan blade blocks.

14. The fan assembly of claim 1 in which the first integrated sub-assembly is configured in a plurality of sections coupled together about the pole.

15. The fan assembly of claim 14 in which the second integrated sub-assembly is configured in a plurality of sections coupled together about the first integrated sub-assembly.

16. The fan assembly of claim 1 in which the support housing further includes at least one lamp.

17. The fan assembly of claim 1 further including a drive train sub-assembly coupling the motor to the drive ring drive mechanism and configured to slip if there is interference with a fan blade which stops the drive ring from rotating.

18. The fan assembly of claim 17 in which the drive train sub-assembly includes at least one belt which slips if there is interference with a fan blade.

19. A fan blade assembly for a pole, the fan blade assembly comprising:

a support housing coupled to but spaced from a motor housing having a motor therein, each housing configured in sections which can be clamped about a pole; and a separate drive ring with fan blades extending therefrom also configured in sections which can be disposed about the pole, the drive ring disposed between the motor housing and the support housing and supported for rotation about the pole on the support housing.

20. The fan assembly of claim 19 further including a split collar and wherein the support housing is attached to a lower end of the split collar and the motor housing is attached to an upper end of the split collar, the separate drive ring rotatably disposed about the split collar between the support housing and the motor housing.

21. The fan assembly of claim 19 in which the support housing includes an upper drive ring support plate.

22. The fan assembly of claim 19 further including a drive ring drive mechanism integrated with the drive ring.

23. The fan assembly of claim 21 in which the upper drive ring support plate includes a plurality of spaced non-rotatable bearing members extending upwards therefrom on which a lower surface of the drive ring rotates.

24. The fan assembly of claim 19 in which the motor housing includes a motor drive mechanism depending downward therefrom which cooperates with a drive ring drive mechanism integral with the drive ring to rotate the drive ring.

25. The fan assembly of claim 24 in which the motor drive mechanism is a first gear and the drive ring drive mechanism is a second gear which is engaged by the first gear.

26. The fan assembly of claim 25 in which the motor housing includes a motor, a motor pulley, an intermediate pulley, a pulley attached to the first gear, a first belt about the motor pulley and the intermediate pulley, and a second belt about the intermediate pulley and the pulley of the first gear.

27. The fan assembly of claim 19 in which the motor housing includes a DC motor and a rechargeable DC battery for powering the DC motor.

28. The fan assembly of claim 27 further including a recharging device for the rechargeable DC battery.

29. The fan assembly of claim 19 in which the support housing includes a switch electrically coupled to the motor in the motor housing.

30. The fan assembly of claim 20 in which the split collar includes a clamp mechanism which secures the support housing, the motor housing, and the split collar to the pole.

31. The fan assembly of claim 30 in which the clamp mechanism is quick release type clamp for quickly adjusting the position of the fan assembly on the pole when an umbrella canopy is lowered for storage and raised for use.

32. The fan assembly of claim 19 further including a spacer element disposed on an upper surface of the drive ring, and a drive ring drive mechanism attached to the spacer element.

33. The fan assembly of claim 19 in which the drive ring includes a plurality of fan blade blocks located thereon each having a channel for receiving a fan blade therein.

34. A fan assembly of claim 33 in which the fan blades each have a distal end with at least one spring mechanism for retaining the distal end of the fan blades in the channels of the blade blocks.

35. The fan assembly of claim 19 in which the support housing further includes at least one lamp.

36. The fan assembly of claim 19 further including a drive train sub-assembly coupled between the motor and the drive ring and configured to slip if there is interference with a fan blade which stops the drive ring from rotating.

37. The fan assembly of claim 36 in which the drive train sub-assembly includes at least one belt which slips if there is interference with a fan blade.

38. A fan assembly for an umbrella, the fan assembly comprising:

a first integrated sub-assembly clampable about a pole, the first integrated sub-assembly including:

a split collar surrounding the pole, a support housing located on a lower end of the split collar defining a drive ring support plate having a plurality of fixed bearing members upstanding therefrom, and a motor housing enclosing a D.C. motor and a rechargeable battery therein located on an upper end of the split collar and spaced from the drive ring support plate; and a second integrated sub-assembly rotatably disposable about the split collar between the support housing and the motor housing, the second integrated assembly including:

a drive ring rotatably disposed about the split collar and having a lower surface which is supported by the fixed bearing members of the drive ring support plate, a drive ring drive mechanism, and a plurality of fan blades coupled to the drive ring.

39. A fan assembly for an umbrella, the fan assembly comprising:

a first integrated sub-assembly clampable about an umbrella pole, the first integrated sub-assembly including:

a split collar surrounding the umbrella pole, a support housing disposed on a lower end of the split collar defining a drive ring support plate, a motor housing enclosing a D.C. motor and a rechargeable battery disposed therein located on an upper end of the split collar and spaced from the drive ring support plate;

a second integrated sub-assembly rotatably disposable about the split collar between the support housing and the motor housing, the second integrated assembly including:

a drive ring rotatably disposed about the split collar and having a lower surface which is supported by the drive ring support plate, a drive ring drive mechanism, and a plurality of fan blades coupled to the drive ring; and a charger for the rechargeable battery.

40. A fan assembly for an umbrella, the fan assembly comprising:

a first integrated sub-assembly clampable about a pole, the first integrated sub-assembly including:

a collar surrounding the pole, a support housing disposed on a lower end of the collar defining a drive ring support plate, a motor housing enclosing a motor and a slipable drive train sub-assembly therein disposed on an upper end of the collar spaced from the drive ring support plate; and a second integrated sub-assembly rotatably disposable about the umbrella pole, the second integrated assembly including:

a drive ring rotatably disposed about the collar and having a lower surface which is supported by the drive ring support plate of the support housing, a drive ring drive mechanism coupled to the slipable drive train sub-assembly of the motor housing, and a plurality of fan blades coupled to the drive ring.

41. A fan blade assembly for a pole, the fan blade assembly comprising:

a support housing coupled to but spaced from a motor housing having a D.C. motor and a rechargeable battery therein, each housing configured in sections which can be clamped about a pole;

a separate drive ring with fan blades extending therefrom also configured in sections which can be disposed about the pole, the drive ring disposed between the motor housing and the support housing and supported for rotation on the support housing; and a battery charger for the rechargeable battery.

42. A fan blade assembly for a pole, the fan blade assembly comprising:

a split collar;

a support housing coupled to the split collar and spaced from a motor housing also coupled to the split collar, the motor housing having a motor therein, each housing configured in sections which can be clamped about a pole; and a separate drive ring with fan blades extending therefrom also configured in sections which can be disposed about the split collar, the drive ring disposed between the motor housing and the support housing and supported for rotation about the split collar on the support housing.

43. A fan assembly comprising:

a first sub-assembly clampable about a pole, the first sub-assembly including:

a collar surrounding the pole;

a support on a lower end of the collar defining a drive ring support;

a motor housing enclosing a motor therein disposed on the collar; and a second integrated sub-assembly rotatably disposable about the umbrella pole, the second integrated sub-assembly including:

a drive ring rotatably disposed about the collar, and a drive ring drive mechanism directly supported by the drive ring support, and a plurality of fan blades coupled to the drive ring.

44. A fan assembly comprising:

a first sub-assembly clampable about a pole, the first sub-assembly including:

a collar surrounding the pole;

a support on a lower end of the collar defining a drive ring support;

a motor housing enclosing a motor therein disposed on the collar; and a second integrated sub-assembly rotatably disposable about the umbrella pole, the second integrated sub-assembly including:

a drive ring rotatably disposed about the collar, and a drive ring drive gear directly supported by the drive ring support, and a plurality of fan blades coupled to the drive ring.

* * * * *